United States Patent [19]

Moore et al.

[11] Patent Number: 4,759,721

[45] Date of Patent: Jul. 26, 1988

[54] COMPLIANT PRESS FIT PIN

[75] Inventors: James R. Moore; Rhonda L. Nemcovsky; Robert S. Orbanic, all of Warren, Pa.

[73] Assignee: GTE Products Corporation, Stamford, Conn.

[21] Appl. No.: 16,808

[22] Filed: Feb. 20, 1987

[51] Int. Cl.[4] ..... H01R 13/428

[52] U.S. Cl. ..... 439/82; 439/751

[58] Field of Search ..... 439/81, 82, 751, 873, 439/733, 825–827

[56] References Cited

U.S. PATENT DOCUMENTS

| | | | |
|---|---|---|---|
| 3,824,554 | 7/1974 | Shoholm | 439/873 |
| 4,469,394 | 9/1984 | Verhoeven | 439/873 |
| 4,606,589 | 8/1986 | Elsbree, Jr. et al. | 439/751 |

*Primary Examiner*—Gil Weidenfeld
*Assistant Examiner*—Gary F. Paumen
*Attorney, Agent, or Firm*—William H. McNeill

[57] ABSTRACT

A press-fit electrical connector has a compliant portion formed of two, opposed, T shaped segments. The facing legs of the segments are offset from one another and their interior surfaces do not make contact when the segments are compressed by insertion into a hole.

7 Claims, 2 Drawing Sheets

FIG. 2
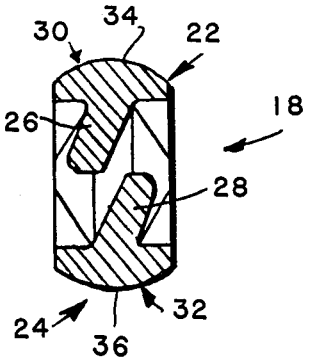
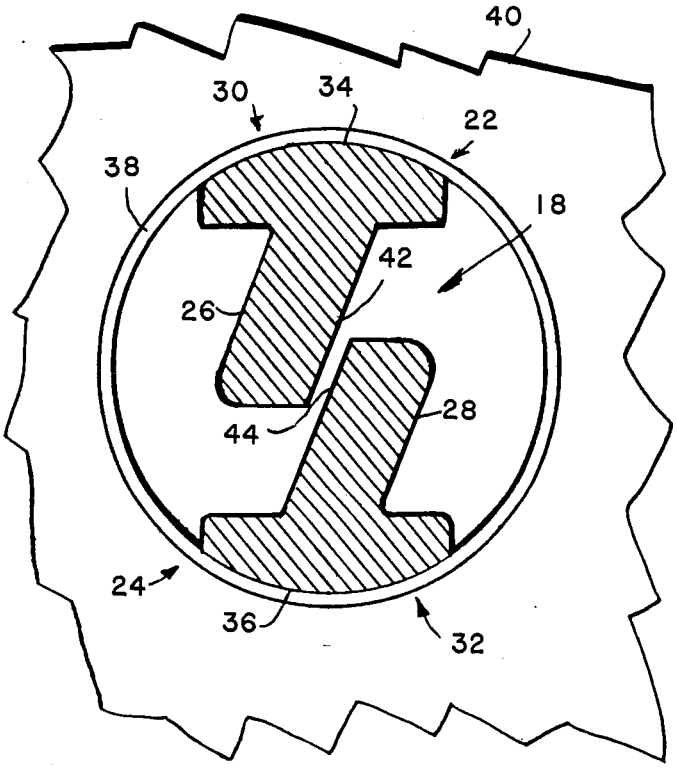
FIG. 4

COMPLIANT PRESS FIT PIN

TECHNICAL FIELD

This invention relates to electrical connectors and more particularly to such connectors having a compliant section. Still more particularly, it relates to such connectors for insertion into plated through holes in printed circuit boards.

BACKGROUND ART

Modern electronic apparatus makes extensive use of printed circuit boards employing plated through holes (PTH). As an alternative to soldering connectors in these holes, it has been proposed to use connectors which engage the hole by friction only. Such connectors generally employ a compliant section for engagement to provide good mechanical and electrical contact. It is desirable that minimum damage be done to the PTH so that such connectors can be removed and replaced. The compliant connectors generally available take several forms: the "eye-of-the-needle" approach, as shown in U.S. Pat. Nos. 3,545,080; 3,634,819; and 4,206,964: the "split beam" approach, shown in U.S. Pat. Nos. 4,066,326; 4,186,982; and 4,443,053: and the "C" section, as shown in U.S. Pat. No. 4,076,356. Another technique has utilized a straight pin having a quadrangular PTH engaging section whose diagonal exceeds the PTH diameter. The latter approach causes considerable damage to the plating and is not suitable for many applications.

While some of the techniques work to a greater or lesser extent, all have one or more problems, such as cost of making; failure to form a good gas tight seal with the PTH; difficulty with insertion; or difficulty of removal.

Disclosure of the Invention

It is, therefore, an object of the invention to obviate the disadvantages of the prior art.

It is another object of the invention to enhance electrical connection in plated through holes.

Yet another object of the invention is the provision of an electrical connector for PTH's which achieves the above objects and, additionally, provides ease of insertion and removal with minimal plating damage.

These objects are accomplished, in one aspect of the invention, by the provision of an electrical connector which comprises a body having a longitudinal axis with a first substantially rigid portion. This portion is joined to a compliant portion having a given longitudinal length measured along the longitudinal axis and formed to provide two oppositely disposed substantially T shaped segments arrayed thereabout. The segments have leg portions which are offset from one another and bar portions whose outer surface, transverse to the longitudinal axis, is arcuate.

This connector provides good mechanical and electrical contact with a PTH.

BRIEF DESCRIPTION OF THE DRAWINGS

FIG. 2 is a sectional view taken along the line 2—2 of FIG. 1;

FIG. 4 is a sectional view showing the connector in a PTH.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
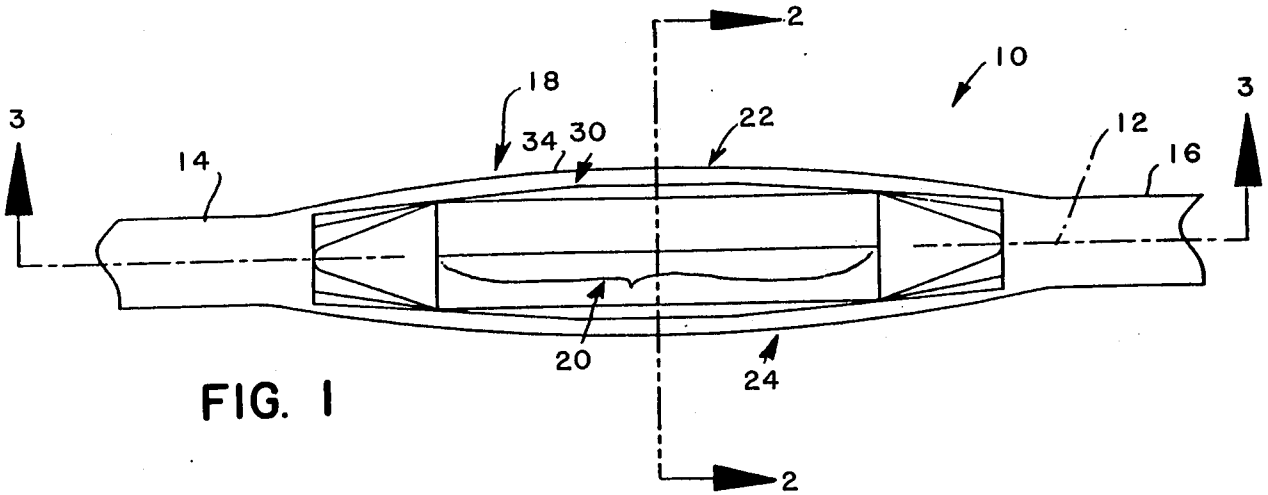
FIG. 1 is an elevational view of an embodiment of the invention.
Figure 3:
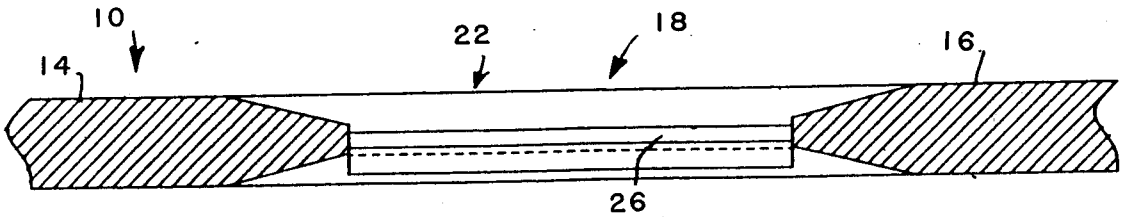
FIG. 3 is a sectional view taken along the line 3—3 of FIG. 1.

Referring now to the drawings with greater particularity, there is shown in FIG. 1 an electrical connector 10 having a longitudinal axis 12. Connector 10 has a first end 14 and a second end 16 which are substantially rigid and spaced apart. These ends may take, at their functional terminations, any desired form. For example, first end 14 may be formed to contact a printed circuit board and second end 16 may be formed as a wire wrap terminal.

The spaced apart first and second ends are separated by and joined to a compliant portion 18 which has a given, split, longitudinal length 20, measured along axis 12. The compliant portion 18 is formed to provide two oppositely disposed, substantially T shaped segments 22 and 24 arrayed about axis 12. The segments 22 and 24 have leg portins 26, 28, respectively, which are offset from one another, and bar portions 30, 32, respectively. The bar portions have outer surfaces 34, 36, respectively, which are arcuate in a direction transverse to axis 12.

Preferably, the radius of the arcuate surfaces 34, 36 is substantially equal to the radius of the PTH into which the connector 10 is to be inserted. Likewise, the given split length 20 is substantially equal to the thickness of the board carrying the PTH.

The compliant portion 18 also is provided with an arcuate surface along the axis 12, as can be seen in FIG. 1. This longitudinal arcuate surface, extending from the first rigid portion to the widest point to the second rigid portion provides a smooth transition area eliminating any sharp corners or angles that could cause hole damage.

The first and second ends 14 and 15 may be any desirable cross-section; however, square is preferred. In a preferred embodiment the connector 10 is made from 0.025" square wire. A suitable material is phosphor bronze. The width of the compliant section 18 at the widest point is about 0.046", for insertion into a 0.040" diameter PTH. Thus, arcuate surfaces 34, 36 have a radius of about 0.020".

FIG. 4 shows connector 10, particularly compliant portion 18, inserted into a PTH 38 formed in a printed circuit board 40 and illustrates the substantially even compression of the T sections and good electrical and mechanical contact with the PTH 38.

Because of the offset provided to legs 26 and 28, the T shaped segments 22 and 24 can be squeezed toward each other without having the interior surfaces 42 and 44 of the legs 26 and 28 come into contact along a major portion of their length, thus avoiding creating a friction surface means which can destroy or severly limit the spring action of the material.

Connectors made in accordance with the teachings herein greatly enhance the art of press-fit connectors. They are simple and economical to fabricate; are easy to insert and remove; cause minimal damage to plated-through-holes; and provide good electrical and mechanical contact.

While there have been shown and described what are at present considered to be the preferred embodiments of the invention, it will be apparent to those skilled in the art that various changes and modifications can be made herein without departing from the scope of the invention as defined by the appended claims.

We claim:

1. An electrical connector comprising: a body having a longitudinal axis with first and second spaced apart, substantially rigid portions separated by and joined to a compliant portion having a given longitudinal length measured along said axis and formed to provide two oppositely disposed, substantially T shaped segments arrayed about said axis; said segments having leg portions which are offset from and not normally in contact with one another and bar portions whose outer surfaces, transverse to said axis, are arcuate.

2. The electrical connector of claim 1 wherein said compliant portion has an arcuate surface along said longitudinal axis.

3. The electrical connector of claim 2 wherein said first and second portions are quadrangular in cross-section.

4. The electrical connector of claim 3 wherein said connector is formed to be inserted into a plated-through-hole in a board having a given thickness and said given length is equal to said given thickness.

5. The electrical connector of claim 3 wherein said first and second portions are square in cross section.

6. An electrical connector comprising: a body having a longitudinal axis with a first substantially rigid portion joined to a compliant portion having a given longitudinal length measured along said axis and formed to provide two oppositely disposed substantially T shaped segments arrayed about said axis; said segments having leg portions which are offset from and not normally in contact with one another and bar portions whose outer surfaces, transverse to said axis, are arcuate.

7. The electrical connector of claim 4 wherein said plated-through-hole has a given radius and said bar portion arcuate surfaces have a radius substantially equal to said given radius.

* * * * *